United States Patent [19]

Schnizlein

[11] Patent Number: 4,643,134

[45] Date of Patent: Feb. 17, 1987

[54] ENGINE COOLING SYSTEM AIR VENTING ARRANGEMENT WITH BUOYANT AIR PURGE VALVE

[75] Inventor: Melvern E. Schnizlein, Inkster, Mich.

[73] Assignee: Ford Motor Company, Dearborn, Mich.

[21] Appl. No.: 743,133

[22] Filed: Jun. 10, 1985

[51] Int. Cl.[4] ..... F01P 7/16

[52] U.S. Cl. ..... 123/41.1; 236/34.5

[58] Field of Search ..... 123/41.08, 41.09, 41.1; 236/34, 34.5

[56] References Cited

U.S. PATENT DOCUMENTS

| | | | |
|---|---|---|---|
| 2,627,868 | 2/1953 | Runnels | 137/202 |
| 2,810,524 | 10/1957 | Puster | 236/34 |
| 2,829,835 | 4/1958 | Branson | 236/34.5 |
| 3,973,729 | 8/1976 | Sliger | 236/34.5 |
| 4,011,988 | 3/1977 | Inagaki | 236/34.5 |
| 4,052,965 | 10/1977 | Morris | 236/34.5 |
| 4,091,991 | 5/1978 | Sliger | 236/34.5 |
| 4,193,542 | 3/1980 | Knauss | 236/34.5 |
| 4,300,718 | 11/1981 | Beyer | 236/34.5 |
| 4,358,051 | 11/1982 | Hunt | 236/34.5 |

FOREIGN PATENT DOCUMENTS

| | | | |
|---|---|---|---|
| 1169723 | 5/1964 | Fed. Rep. of Germany . | |
| 893671 | 4/1962 | United Kingdom . | |
| 1401396 | 7/1975 | United Kingdom | 236/34.5 |

*Primary Examiner*—William A. Cuchlinski, Jr.
*Attorney, Agent, or Firm*—Robert E. McCollum; Clifford L. Sadler

[57] ABSTRACT

An engine coolant system contains a thermostat in a horizontally disposed line from the engine and a horizontally disposed air vent or bypass passage located above the thermostat to bleed air from the system. The bypass system contains a buoyant valve having a duckbill-like shape that pivots to one position by buoyancy in response to coolant flow to seal an air vent opening to the radiator, or to a return non-buoyant position permitting the bleed of air; one embodiment providing a valve with a buoyant insert as well as a weight insert; a second embodiment consisting entirely of a material buoyant in the conventional engine coolant.

7 Claims, 6 Drawing Figures

ENGINE COOLING SYSTEM AIR VENTING ARRANGEMENT WITH BUOYANT AIR PURGE VALVE

This invention relates in general to an automotive engine coolant system. More particularly, it relates to an air venting arrangement for purging the coolant system of air pockets that might inhibit complete filling of the cooling system. Still more particularly, it relates to the use and location of a buoyant valve in a horizontally disposed air vent passage that bypasses the conventional thermostat in a manner to provide complete purging of the coolant system of air.

Automotive engine coolant systems are known in which the thermostat contains a bleed air opening to permit venting of air from the coolant passage to the radiator to eliminate air pockets in the cylinder head, for example. Trapped air can subject the engine parts to substantial temperature increases and result in warping or other deleterious effects.

Some of the known prior systems contain so-called "jiggle pin" type check valves, such as is shown, for example, in U.S. Pat. No. 2,810,524, Puster, element 212; U.S. Pat. No. 2,829,835, Branson, Element 82; German Pat. No. 1169723 and British Pat. No. 893671. These small area rivet like pins located in the thermostat fall by gravity to a position permitting flow of air around the pin to eliminate air pockets in the coolant passages. They seat to seal somewhat against the flow of coolant past the thermostat in response to the pressure of coolant against the valve. As shown in the above references, however, the thermostat is vertically arranged, and any air bubble will naturally rise to the top of the coolant and be vented.

Problems associated with the construction of the above prior art are that (1) the thermostat size must be large enough to permit the inclusion of a hole and jiggle pin of sufficient size to provide the proper flow characteristics; (2) the substitution of the whole thermostat is required to change jiggle pin and hole sizes; and (3) the use of a rivet type jiggle pin with its rough surfaces does not provide an adequate seal against leakage of coolant flow and, therefore, may provide less than desirable passenger car heater performance.

Other forms of air vent check valves and bypass passages are known, as illustrated in U.S. Pat. No. 3,973,729, Sliger, and U.S. Pat. No. 4,011,988, Inagaki, for example. In Sliger, an opening is made in the side wall of the thermostat housing for a ball check valve housing, the ball falling by gravity to permit venting of air from the coolant passage, and being movable by coolant to seat and seal against the passage of coolant past the thermostat. The valve and passage are contained within the thermostat per se. In Inagaki, the thermostat closure plate requires an extension in which is located a thermally responsive bypass valve 20. In both of these references, the thermostat is located to operate in essentially a vertical direction so that the location of the air vent is not of prime importance. British Pat. No. 1,401,396 shows a bypass passage containing a jiggle pin that is located not in the thermostat, but in the coolant outlet housing, but again this is a vertical installation type thermostat. Also of interest is the vent valve in U.S. Pat. No. 2,627,868. Here a buoyant valve with a weight at one end rises vertically to block the flow of liquid.

This invention relates to a thermostat of a horizontally movable type; that is, one in which the coolant flows past the thermostat in essentially a horizontal direction and thereafter changes more or less to a vertical direction to connect to tubing leading to the radiator inlet. In this type of installation, location of the air vent is of the utmost importance to assure a complete purging of the cooling system of air. U.S. Pat. No. 4,091,991, for example, illustrates a horizontally disposed thermostat having a pair of air bypass passages or vents 35 that permit venting of air from the coolant flow. In this case, the thermostat is positioned so that at least one of the pockets 35 is located at a high position in the thermostat to allow air trapped in the coolant to be vented before the coolant reaches a level almost to the top of the thermostat. Again, however, it will be seen that since the air venting pocket is located in the thermostat per se, air can be trapped in the coolant at a level between the air pocket and the housing portion vertically above the thermostat.

U.S. Pat. No. 4,300,718, Beyer, is of particular interest in showing an air vent bypass passage located vertically above a horizontally disposed thermostat. The bypass passage in this case is diagonally disposed and supposedly large enough relative to the size of a ball valve retained therein to be movable by coolant to a flow blocking position while dropping by gravity to a non-flow blocking air bleed position. However, if the valve is only slightly smaller than the passage, air pressure also could seat the valve, and thereby prevent elimination of the air bubbles. Furthermore, once seated, the air pressure forces would tend to keep it seated even though the buoyancy changes temporarily because of the presence of an air bubble instead of coolant.

It is an object of the invention, therefore, to provide an engine coolant air venting arrangement that eliminates the disadvantages of the known horizontally disposed constructions by providing a horizontally disposed air venting passage located in the coolant outlet housing and containing a buoyant valve in the passage of a construction that permits a maximum purging of air from the coolant passages without leakage of coolant itself to the radiator.

It is another object of the invention to provide an air venting arrangement of the type described in which the air bypass vent passage contains in one embodiment a duckbill-like shaped buoyant valve with a weight, a second embodiment having essentially the same shape constructed entirely of buoyant material, both embodiments permitting the flow of air into the radiator from the coolant passage when the thermostat is closed, but a sealing by the valve against the flow of coolant to the radiator.

Other objects, features and advantages of the invention will become more apparent upon reference to the succeeding, detailed description thereof, and to the drawings illustrating the preferred embodiments thereof, wherein.

Figure 1:
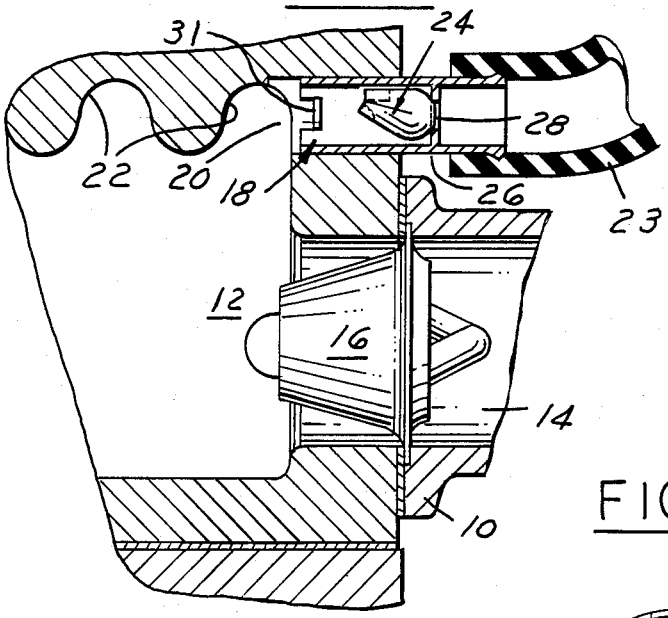
FIG. 1 is a cross-sectional view of a portion of an engine coolant outlet housing embodying the invention.

FIG. 1 shows a portion of an engine and its thermostat housing. Engine cooling systems are well known for circulating the flow of coolant from a high point of the engine cylinder head to the radiator for return to the engine by means of a water pump for further heat exchange. More particularly, the engine coolant system usually includes a water or coolant outlet housing at the front end of the engine near the top or hottest portion of the engine. A thermostat is inserted at this point to prevent flow of the coolant into the radiator until a predetermined coolant temperature level is obtained. When this happens, the thermostat will open and the coolant will circulate through the radiator to be cooled by air flow therethrough and then drawn back into the engine by the water pump for a further heat exchange action.

The thermostatic installations generally are of two types. One locates the thermostat in the end of a vertical conduit so as to be movable vertically to open or close the passage. Air trapped in the coolant behind the thermostat generally escapes through a constant leak type hole in the thermostat or through a jiggle pin type valve previously described above, there being little hindrance to the passage of air since the passage is at the same level as the thermostat seal surface. The second form of installation and one with which this invention is concerned is one in which a horizontally movable thermostat is provided that connects to a right angled passage leading to the radiator. In this instance, any air trapped behind the thermostat may remain so trapped if not enough circulation can occur and more importantly if an air vent is not provided that is sufficiently higher than the coolant level.

This invention is directed to an arrangement to assure an efficient operation of the horizontal type thermostat by the efficient venting of air from the coolant system. More particularly, FIG. 1 shows an end of a shell type coolant outlet housing 10. It is attached to one end of the engine cylinder head over the end of a coolant discharge passage 12 located at the uppermost portion of the head. The other end, not shown, of housing 10 is adapted to be connected by a flexible tubular hose or similar conduit, also not shown, to the inlet or upper portion of a conventional radiator.

As viewed in FIG. 1, the passages 12 and 14 are horizontally disposed, the passage 14 receiving therein a known type of horizontally movable thermostat 16.

Turning to the invention, the cylinder head is provided with an air vent bypass passage 18. It has an inlet portion 20 located vertically above the outermost vertical point of passage 12 with which thermostat 16 communicates. Passage 18 is connected by tubing 23 upwardly to a portion of the larger hose, not shown, connected to the radiator. Such a construction permits any air trapped in this portion of the coolant passage upstream of thermostat 16 to be vented into the connecting hose and therefrom into the radiator due to its location at a vertical point higher than the highest inlet portion of the coolant flow passage. Passage 12 in this case is shown with pockets 22 that result from the process of casting of the cylinder head. Air trapped in passage 12 migrates to these pockets 22 and therefore must be driven therefrom to be vented through passage 18. This is done by allowing sufficient circulation of flow of air and coolant.

The venting of the air through passage 18 is controlled in this case by a buoyant check valve 24 enclosed in a cylindrical valve housing 26. The valve housing has an air opening 28 at one end of a controlled size also forming a valve seat for sealing of the opening when the end 30 of valve 24 is forced up against it by the coolant. The housing 26 is crimped at its left hand end 31 as seen in FIG. 1 to a diameter smaller than valve 24 to retain the valve in the valve housing. The valve otherwise is freely movable within the valve housing in a manner now to be described.

Figure 2:
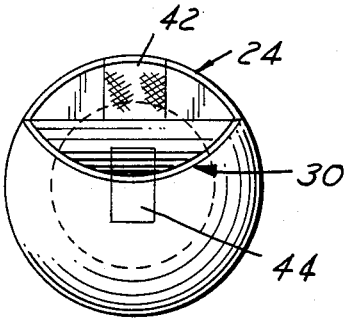
FIG. 2 is an enlarged cross-sectional view taken on a plane indicated by and viewed in the direction of the arrows II—II of FIG. 3.
Figure 3:
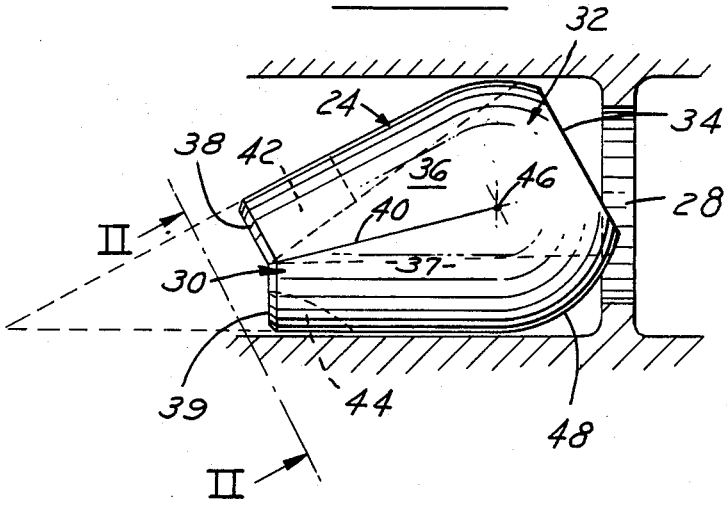
FIG. 3 is an enlarged cross-sectional view of an element of FIG. 1 illustrating the element in a different operative position.

Referring to FIGS. 2 and 3, the valve 24 initially is formed from a cylindrical piece of material with a balled or semi-spherical end 30. A longitudinally extending wedge of the rod is then removed forming two symmetrically shaped portions 36 and 37 on opposite sides of the longitudinal centerline 40 of the valve. The two side portions 36 and 37 then are collapsed to in effect form an overall duckbill-like shape to the valve. The smaller end 30 is then machined at right angles to the sides to form two flat end faces 38 and 39. The larger end 36 also is machined to remove a circular segment of the balled end leaving a flat valve face 34.

The upper or more vertical portion 36 is provided with a buoyant insert 42 adjacent the face 38, the lower portion 37 containing a weight insert 44 adjacent face 39. This provides moments of force about the center point 46 for the semi-circular end portion 32 on the valve. The buoyancy of the valve and the pressure differential against it thus pivots it about point 46 on surface 48 in response to flow of coolant into bypass passage 18, from the position shown in FIG. 3 to the valve seated position shown in FIG. 1.

The force of the buoyancy of valve 24 in the coolant times the moment arm distance to centerpoint 46 will provide a clockwise movement about point 46 to pivot the flat face 34 of the valve from the air bleed position shown in FIG. 3 to the flow blocking position shown in FIG. 1. In this position, the semi-spherical surface adjacent the face 34 provides a line contact seat against the edge of the valve seat defined by opening 28. As the coolant level drops or the flow is interrupted by an air bubble, the upward buoyancy force is replaced by the downward force of the weight 44 times the distance to point 46 creating a moment causing the valve to pivot in a counterclockwise direction about 46 to return the valve to the FIG. 3 air bleed position. It will be clear that this construction also provides a self-righting advantage so that the valve is always positioned correctly to function in the manner desired and will not rotate.

The operation is believed to be clear from the above description and a consideration of the drawings. However, in brief, below a predetermined temperature level, coolant flow past thermostat 16 will be blocked upon the seating of the thermostat except for the usual controlled bypass flow to the heater block, not shown. The air contained in pockets 22 now can escape through the bypass passage 18 past valve 24, which will have fallen away from opening 28 to permit the air to pass through the bypass passage to the radiator. By the time the air pockets have been eliminated, the coolant flow will have begun to reach the outermost diameter of the thermostatic housing. Further increases in the level of the coolant then will pivot the valve 24 to seat against the opening 28 and seal against leakage of any flow of coolant towards the radiator. Therefore, so long as thermostat 16 remains closed, no coolant flow through passage 18 will occur.

Figure 4:
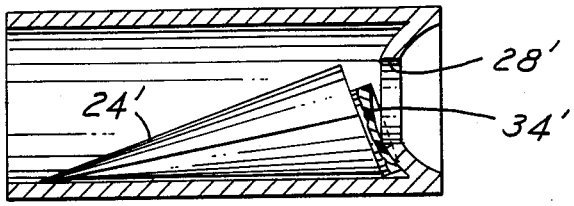
FIGS. 4 and 5 are cross-sectional views of a modified embodiment of the invention, in different operative positions.
Figure 6:
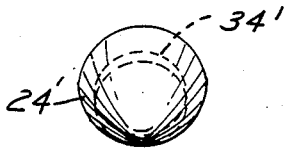
FIG. 6 is an end view in the direction of the arrows VI—VI of FIG. 5.
Figure 5:
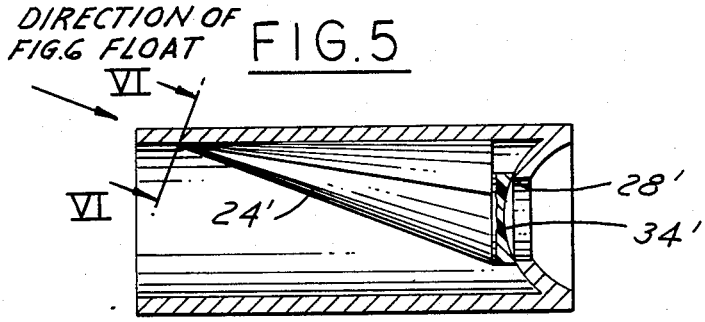

FIGS. 4–6 show an alternative embodiment. In this case, the valve 24' is constructed or machined of a similar shape as that in FIGS. 1–3 entirely of a buoyant material, such as from polypropelene stock, which is buoyant in a glycol solution. No inserts or weights are necessary as the buoyancy and pressure differential forces acting on the valve will orient the valve into the upright position of FIG. 5 if initially installed as shown in FIG. 4 rotated out of the upright position. The valve per se again has a duckbill-like shape with, in this case, a concave shaped face 34' that mates with a spherically formed valve seat having an opening 28'. In all other respects, the valve 24' of FIGS. 4–6 pivots and moves in essentially the same manner as the valve 24 of FIGS. 1–3.

From the above, it will be seen that the invention provides an engine coolant air venting arrangement that assures a greater elimination of air pockets in the coolant than previous constructions and, therefore, provides a greater protection to engine parts from overheating. It will be seen that the above is provided by an air bypass passage that is located above the highest point of the coolant passage so that air pockets existing in the coolant can be properly vented. It will further be seen that a buoyant check valve in a bypass passage is employed to permit the egress of air from the coolant while preventing leakage of coolant towards the radiator through the passage, which would be detrimental to the efficiency of the vehicle heater system.

While the invention has been shown and described in its preferred embodiments, it will be clear to those skilled in the arts to which it pertains that many changes and modifications may be made thereto without departing from the scope of the invention.

I claim:

1. An air vent arrangement for the cooling system of an automotive type engine having a radiator with a coolant inlet, the engine having coolant passages communicating with the radiator through an outlet essentially horizontally disposed, tubing connecting the radiator inlet and coolant outlet, a thermostat in the outlet horizontally movable to open and closed positions, and a horizontally disposed air bleed bypass passage located vertically above the thermostat connecting the coolant outlet to a portion of the tubing downstream of the thermostat bypassing the same when the thermostat is in a closed position for bleeding air from the cooling system, the bypass passage having a valve therein movable between a position blocking flow of coolant through the same and a second position opening the passage permitting the bleed of air therethrough, the valve being buoyant and constructed and arranged to pivot from a non flowblocking air bleed position into a flow blocking position in response to flow of coolant into the bypass passage acting thereagainst.

2. An arrangement as in claim 1, wherein the bypass passage has a valve seat formed therein at right angles thereto, the valve having a semi-spherical end portion pivotal to seat against the seat to block coolant flow.

3. An arrangement as in claim 2, wherein the valve has a duckbill-like shape having large and small end portions with the semi-spherical portion being formed at the large end portion, the valve swinging about the center of the semi-spherical end portion to align the latter portion with the seat.

4. An arrangement as in claim 3, wherein the smaller end portion contains a buoyant insert and a weighted element, the buoyant insert being located vertically above the longitudinal centerline of the valve, the weight being located below the centerline.

5. An arrangement as in claim 1, wherein the valve is made entirely of a material buoyant in the coolant.

6. An arrangement as in claim 1, wherein the valve contains an insert of buoyant material for arcuately pivoting the valve in one direction and a weight to return the valve in the opposite direction.

7. An arrangement as in claim 6, wherein the valve has a duckbill-like shape with large and small end portions, the large end portion having a spherical segment cut therefrom to define a flat face permitting air to bypass into the opening between the valve and the housing, the large end pivoting about the spherically shaped end portion as a fulcrum.

* * * * *